US008315544B2

(12) United States Patent
Eun et al.

(10) Patent No.: US 8,315,544 B2
(45) Date of Patent: Nov. 20, 2012

(54) IMAGE FORMING APPARATUS INCLUDING DEVELOPER CONTACT MEDIA HAVING NANO-SCALE ROUGHNESS

(75) Inventors: Jong-moon Eun, Seoul (KR); Cheol-soo Yang, Yeongtong-gu (KR); Jean-man Sur, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 522 days.

(21) Appl. No.: 12/543,617

(22) Filed: Aug. 19, 2009

(65) Prior Publication Data

US 2010/0143007 A1 Jun. 10, 2010

(30) Foreign Application Priority Data

Dec. 9, 2008 (KR) ..... 10-2008-0124748

(51) Int. Cl.
*G03G 15/06* (2006.01)

(52) U.S. Cl. ..... 399/286; 399/98; 399/122

(58) Field of Classification Search ..... 399/98, 399/99, 111, 116, 122, 159, 162, 222, 239, 399/297, 299, 302, 303, 308, 320, 324–326
See application file for complete search history.

(56) References Cited

U.S. PATENT DOCUMENTS

| | | | | |
|---|---|---|---|---|
| 2003/0152857 | A1* | 8/2003 | Sugiura et al. | 430/109.2 |
| 2004/0265016 | A1* | 12/2004 | Kitani et al. | 399/298 |
| 2005/0145285 | A1* | 7/2005 | Extrand | 138/39 |
| 2005/0255393 | A1* | 11/2005 | Nakata et al. | 430/56 |
| 2006/0110568 | A1* | 5/2006 | Edwards | 428/64.4 |
| 2010/0068434 | A1* | 3/2010 | Steele et al. | 428/36.9 |

FOREIGN PATENT DOCUMENTS

| | | |
|---|---|---|
| JP | 2000-075931 | 3/2000 |
| JP | 2002-108127 | 4/2002 |
| JP | 2003-287964 | 10/2003 |
| JP | 2006-010921 | 1/2006 |

* cited by examiner

*Primary Examiner* — Walter L Linday, Jr.
*Assistant Examiner* — Jessica L Eley
(74) *Attorney, Agent, or Firm* — Stanzione & Kim, LLP

(57) ABSTRACT

Provided is an image forming apparatus which includes a developer to develop an image and a developer contact medium of which a surface contacts the developer, wherein asperities with a density of about $4\times10^8$ to about $200\times10^8$ pcs/cm$^2$ are formed to form roughness on the surface of the developer contact medium.

11 Claims, 25 Drawing Sheets

IMAGE FORMING APPARATUS INCLUDING DEVELOPER CONTACT MEDIA HAVING NANO-SCALE ROUGHNESS

CROSS-REFERENCE TO RELATED APPLICATIONS

This application claims priority under 35 U.S.C. §119(a) from Korean Patent Application No. 10-2008-0124748, filed on Dec. 9, 2008, in the Korean Intellectual Property Office, the disclosure of which is incorporated herein in its entirety by reference.

BACKGROUND

1. Field of the Invention

The present general inventive concept relates to an image forming apparatus including developer contact media such as a developing member, a photosensitive member, a transfer member, and a fusing member.

2. Description of the Related Art

Image forming apparatuses such as printers and photocopiers develop a desired image using a toner that functions as a developer, and print the image on a printing medium, such as paper. Currently, a diameter of a toner particle is getting smaller in order to realize high-resolution image quality. That is, the particles of a toner are formed as small as possible in order to increase a definition of an image to be developed with the toner particles. However, as the toner particles become smaller, an adhesion force of the toner with respect to a medium to which the toner adheres to greatly increases. Thus, with respect to some media, such as a developing member, a photosensitive member, and a transfer member, to which the toner temporarily adheres and from which the toner moves to a neighboring member, although a stable printing operation can only be performed when the toner clearly moves to the neighboring member, if the adhesion force excessively increases as described above, the toner cannot clearly move and residual toner can remain. Also, with respect to a medium such as a fusing member that presses and fixes a developer by using heat and pressure, direct contact with the developer occurs and thus, if the adhesion force of the toner excessively increases, surface contamination can occur due to the toner. As such, a high-quality image cannot be printed. Accordingly, a scheme for reducing the diameter of the toner particle while reducing the adhesion force of the toner with respect to a medium to which the toner adheres to is required.

SUMMARY

The general inventive concept provides an image forming apparatus including a developer to develop an image and developer contact medium formed with a roughness on surfaces thereof.

Additional features and/or utilities of the present general inventive concept will be set forth in part in the description which follows and, in part, will be obvious from the description, or may be learned by practice of the general inventive concept.

The present general inventive concept provides an image forming apparatus including a developer to develop an image and a developer contact medium of which a surface contacts the developer, wherein asperities with a density of about $4\times10^8$ to about $200\times10^8$ pcs/cm$^2$ are formed to form roughness on the surface of the developer contact medium.

The asperities may be protrusions protruded on the surface of the developer contact medium or grooves recessed in the surface of the developer contact medium. The asperities may be nano-scale asperities having a height less than 1 μm.

The asperities may be stripe patterns and a pitch of the asperities may be equal to or less than 500 nm. Alternatively, the asperities may be spherical patterns and a distance between the asperities may be equal to or less than 500 nm.

An adhesion force of the developer with respect to the developer contact medium may be equal to or less than 100 nN.

If the developer contact medium is formed of aluminum, the asperities may be formed by anodizing a surface of the aluminum. If the developer contact medium is formed of rubber, the asperities may be formed by coating a coating solution, in which nano particles having a diameter equal to or less than 1 μm are dispersed, on the surface of the developer contact medium.

The developer contact medium may include one of a developing member, a photosensitive member, a fusing member, and a transfer member, and each of the developing member, the photosensitive member, the fusing member, and the transfer member may be one of a roller type and a belt type.

The present general inventive concept also provides a developing unit usable with an image forming apparatus which includes a developer to develop an image and at least one developer contact medium formed with a surface to reduce a force with the developer, wherein the surface has asperities which include at least one of protrusions and recessed grooves.

The present general inventive concept also provides a developing unit usable with an image forming apparatus which includes a developer to develop an image, and at least one developer contact medium having a treated surface to contact the developer, wherein the treated surface reduces a force of the developer.

The treated surface may reduce an adhesion force between the developer and the at least one developer contact medium.

The treated surface may include asperities having a density of equal to or greater than about $4\times10^8$ pcs/cm$^2$.

The asperities may include at least one of protrusions and recessed grooves.

The asperities may include nano-scale asperities having a height less than about 1 μm.

The present general inventive concept also provides a developing unit usable with an image forming apparatus which includes a developer to develop an image, and at least one developer contact medium formed with a surface to reduce a force with the developer.

The surface may include a roughness formed with asperities having a density of equal to or greater than about $4\times10^8$ pcs/cm$^2$.

The asperities may include at least one of protrusions and recessed grooves.

The asperities may include nano-scale asperities having a height less than about 1 μm.

The present general inventive concept also provides an image forming apparatus which includes a developer to develop an image, and at least one developer contact medium having a treated surface which contacts the developer, wherein the treated surface reduces a force between the developer and the at least one developer contact medium.

BRIEF DESCRIPTION OF THE DRAWINGS

The above and other features and/or utilities of the present general inventive concept will become more apparent by describing in detail exemplary embodiments thereof with reference to the attached drawings in which.

DETAILED DESCRIPTION OF THE EMBODIMENTS

Figure 1:
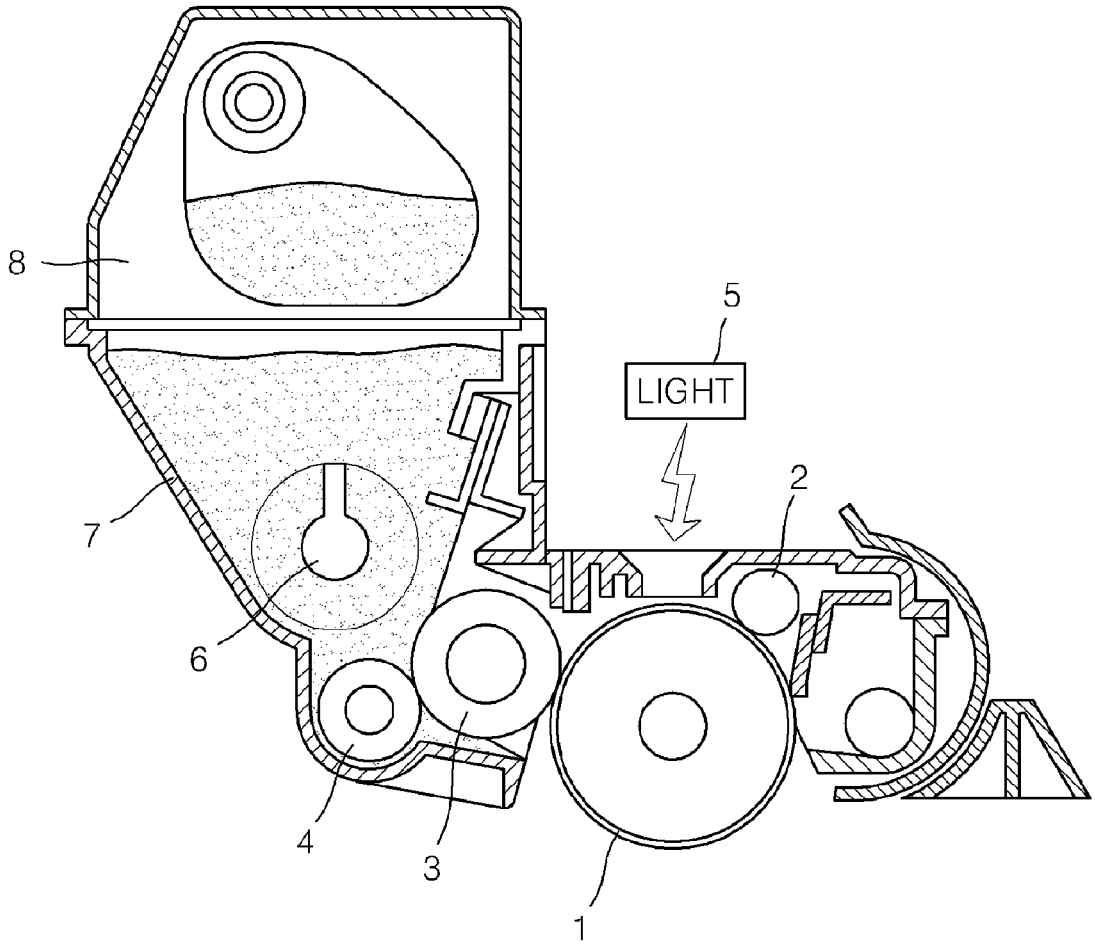
FIG. 1 is a cross-sectional view of an image forming apparatus adopting a developer contact medium, according to an exemplary embodiment of the present general inventive concept.

The present general inventive concept will now be described more fully with reference to the accompanying drawings, in which exemplary embodiments of the present general inventive concept are illustrated. Reference will now be made in detail to the exemplary embodiments of the present general inventive concept, examples of which are illustrated in the accompanying drawings, wherein like reference numerals refer to the like elements throughout. The exemplary embodiments are described below in order to explain the present general inventive concept by referring to the figures FIG. 1 is a cross-sectional view of an image forming apparatus adopting a developer contact medium, according to an exemplary embodiment of the present general inventive concept.

As illustrated in FIG. 1, the image forming apparatus according to the present exemplary embodiment includes a hopper 7 to accomodate a powdery toner as a developer, a toner kit 8 to supply the toner to the hopper 7, an agitator 6 to agitate the toner in the hopper 7, a photosensitive member 1 on which an electrostatic latent image may be formed by an exposer 5, a developing member 3 to develop the electrostatic latent image with the toner by using a potential difference, a supply roller 4 to supply the toner to the developing member 3, etc. In exemplary embodiments, when the electrostatic latent image is developed, a charger 2 charges a surface of the photosensitive member 1 with a fixed potential, the exposer 5 projects light onto the surface of the photosensitive member 1 so as to form the electrostatic latent image thereon, and the developing member 3 adheres the toner to the electrostatic latent image so as to develop the electrostatic latent image into a visualized toner image.

In the above process, the adhesion force of the toner with respect to, for example, the developing member 3 directly influences a development efficiency. If the adhesion force of the toner with respect to the developing member 3 is excessively large, the toner that is to adhere to the electrostatic latent image of the photosensitive member 1 may not appropriately move and thus a clear image may not be formed. If the potential difference is increased in order to solve this problem, the toner may adhere to a non-image region as well as on a region of the electrostatic latent image and thus an unclear image may be formed. As described above in the description of the related art, a contradictive problem such as the above-mentioned problem frequently occurs due to excessive adhesion force as a diameter of a toner particle decreases. The toner image developed on the photosensitive member 1 is transferred to another intermediate transfer member (not illustrated), is transferred to an ultimate print medium from the intermediate transfer member, and is then fused with heat and pressure by a fusing member (not illustrated). Thus, the same problem occurs to the photosensitive member 1, the intermediate transfer member, or the fusing member due to the excessive adhesion force of the toner. That is, the toner image developed on the photosensitive member 1 may not properly transfer to the intermediate transfer member or to the ultimate print medium due to the excessive adhesion force of the toner.

Figure 2:
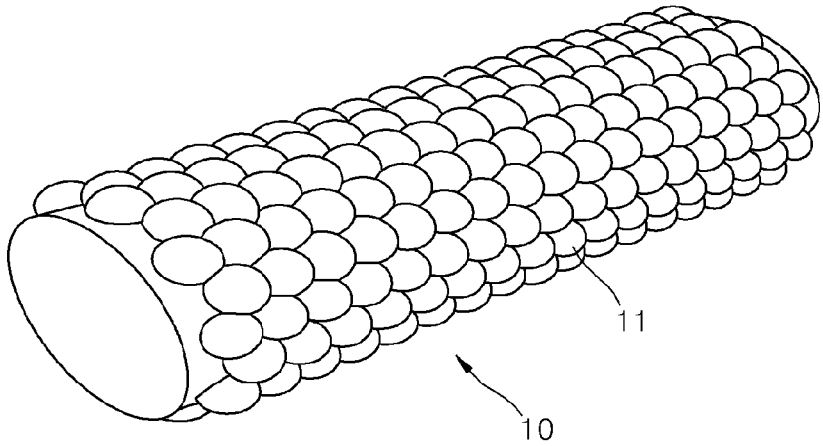
FIG. 2 is a perspective view illustrating an exemplary structure of a developer contact medium illustrated in FIG. 1.

Thus, in order to solve this problem, the present exemplary embodiment maintains the adhesion force of the toner at about 100 nN or less by forming nano-scale roughness on surfaces of developer contact media, such as the developing member 3, the photosensitive member 1, the transfer member, and the fusing member, which contact the toner so that a printing operation may be stably performed, regardless of the development efficiency. In an exemplary embodiment, as illustrated in FIG. 2, the adhesion force of the toner may be reduced by forming nano-scale asperities 11 having a height that is less than about 1 μm on a surface of a developer contact medium 10. The nano-scale asperities 11 may be protrusions protruded on a surface of the developer contact medium 10 as exemplarily illustrated in FIG. 2, or may be grooves recessed in the surface of the developer contact medium 10. However, the present general inventive concept is not limited thereto. That is, in exemplary embodiments, the nano-scale asperities 11 may be formed in various other sizes and shapes by using various methods. In an exemplary embodiment, the developer contact medium 10 may be a roller or a rubber belt. If the developer contact medium 10 is an aluminum roller, the developer contact medium 10 may be formed by electrochemically oxidizing, i.e., anodizing aluminum in a specific electrolyte.

Figure 3A:
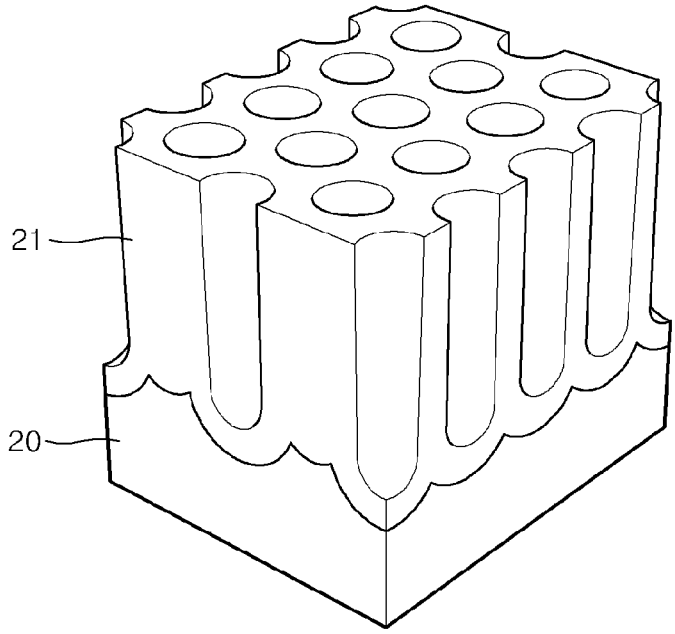
FIGS. 3A through 3E and 4A through 4D are partial perspective views illustrating methods of forming a developer contact medium.
Figure 3B:
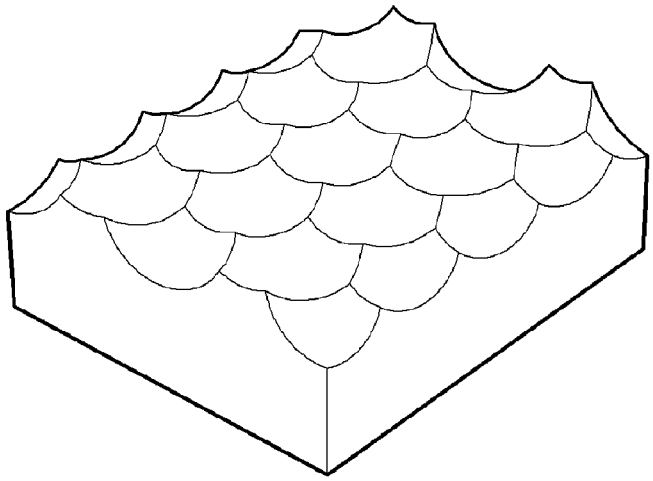
Figure 3C:
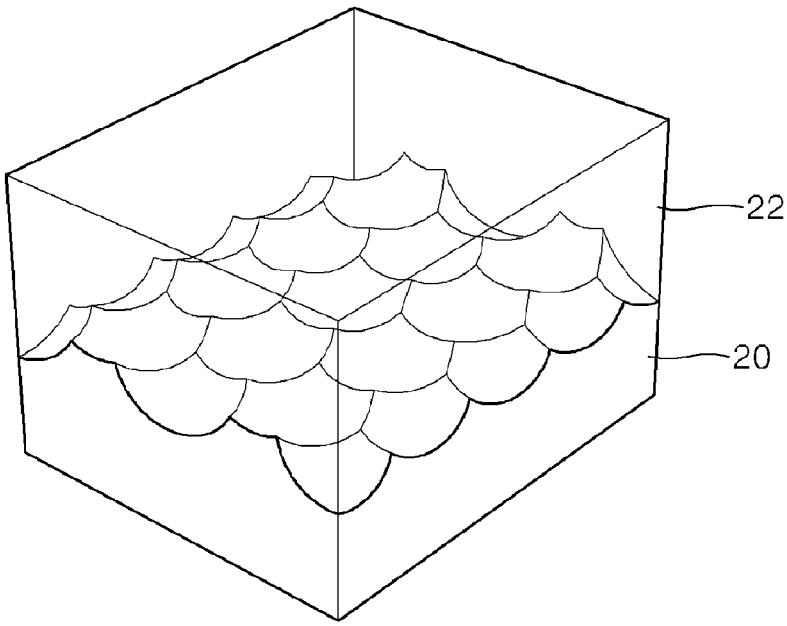
Figure 3D:
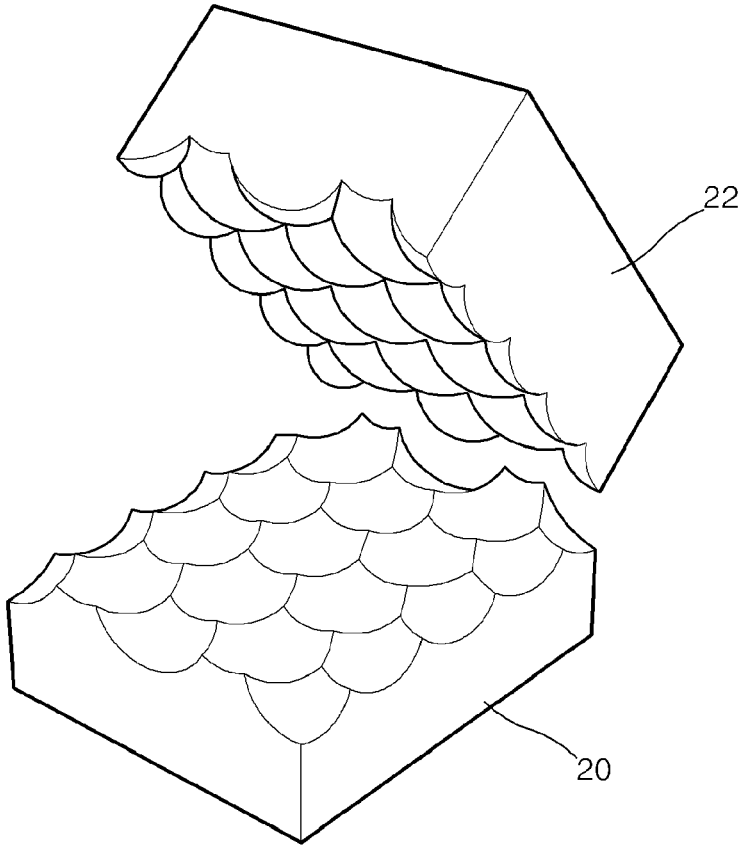
Figure 3E:
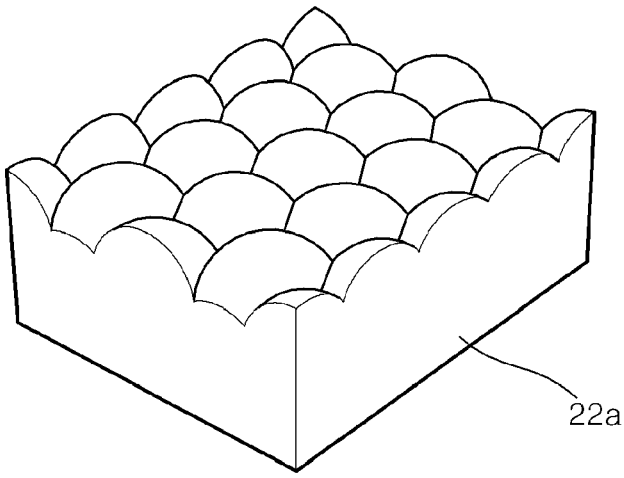

FIGS. 3A through 3E illustrate a method of forming nano-scale roughness by anodizing aluminum. When anodizing is performed, as illustrated in FIG. 3A, an alumina film 21 having vertically aligned voids is formed on a surface of aluminum 20. In an exemplary embodiment, if anodizing is performed in an electrolyte such as a weak oxalic acid, a phosphoric acid, and a sulphuric acid by using a potential difference of about 25V to about 190V, the alumina film 21 having vertically aligned voids in a hexagonal close-packed structure as illustrated in FIG. 3A is obtained. In this case, hemispherical grooves 21 a are formed under the voids, that is, on the surface of the aluminum 20. Thus, if the alumina film 21 melts away by using, for example, a chromic acid of 18 wt %, a structure having hemispherical grooves may be obtained as illustrated in FIG. 3B. In exemplary embodiments, since a diameter of the hemispherical grooves 21*a* may be proportional to a voltage applied when anodizing is performed, a size of asperities 11 may be controlled by controlling the voltage applied thereto. Then, if a polymer layer 22 coated thereon as illustrated in FIG. 3C and a pattern is transferred and separated as illustrated in FIG. 3D, a substrate 22*a* may be formed as illustrated in FIG. 3E. In exemplary embodiments, the substrate 22*a* may be used for an adhesion force test to be described later. Only the grooves 21*a* of the structure illustrated in FIG. 3B are changed into protrusions on the substrate 22*a* and the nano-scale roughness formed on the structure illustrated in FIG. 3B is also formed on the substrate 22*a*.

In exemplary embodiments, if the developer contact medium 10 illustrated in FIG. 2 is a rubber belt, an anodizing method may not be used and thus the nano-scale roughness may be formed by dispersing nano particles having a particle diameter equal to or less than 1 μm in a coating solution and then by spray-coating the surface of the developer contact medium 10. However, the present general inventive concept is not limited thereto. That is, in exemplary embodiments, the nano-scale roughness of the substrate 22*a* may be formed by various other methods.

Figure 4A:
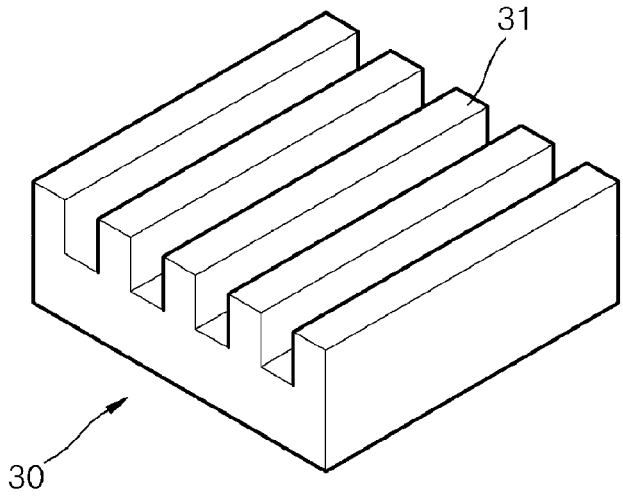
Figure 4B:
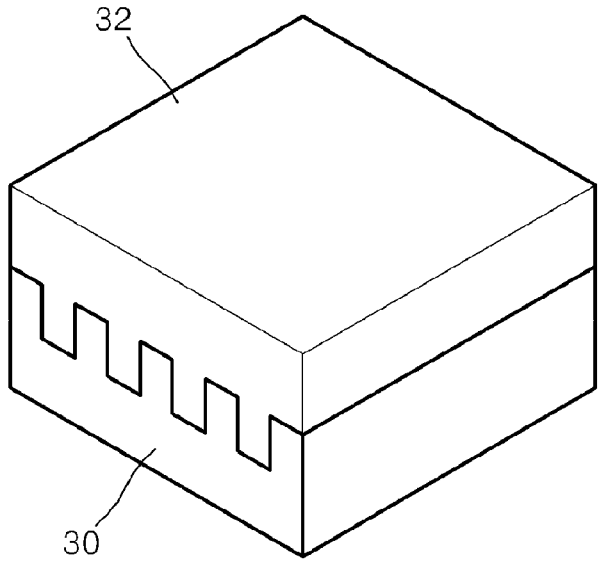
Figure 4C:
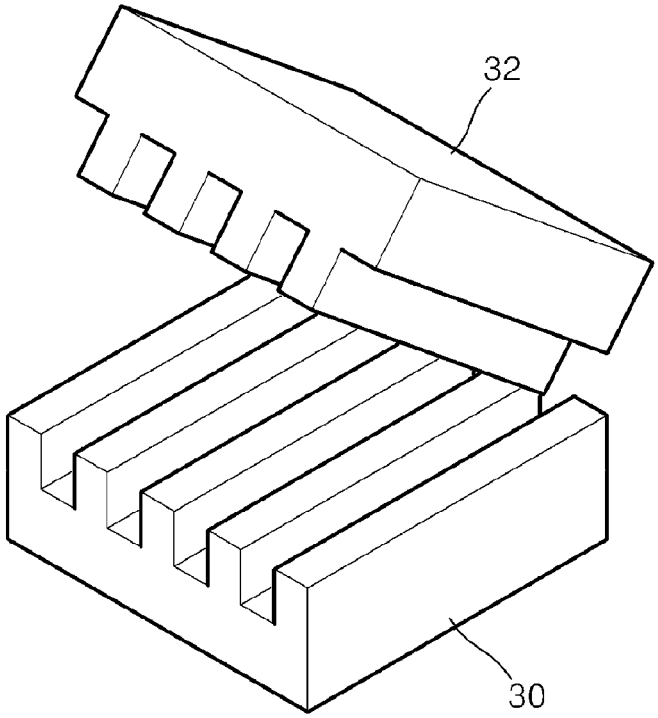
Figure 4D:
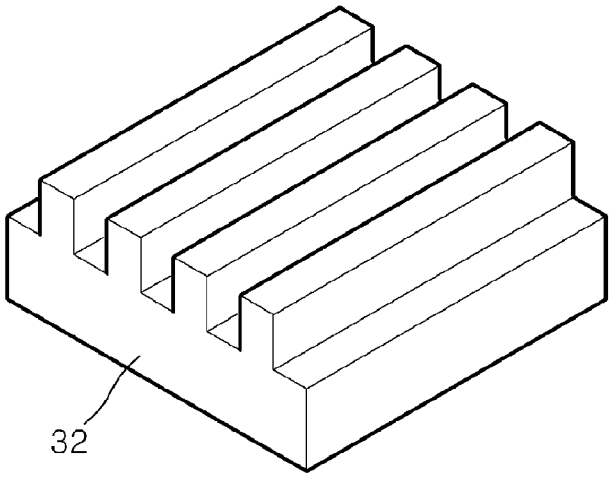

A method of forming nano-scale roughness by using electron beam lithography as illustrated in FIGS. 4A through 4D may also be used. In more detail, as illustrated in FIG. 4A, stripe asperities 31 may be formed on a silicon substrate 30 by using electron beam lithography. However, the present general inventive concept is not limited thereto. Then, if a polymer layer 32 is spin-coated thereon to a thickness of about 100 nm (FIG. 4B) and then annealed and separated (FIG. 4C), a polymer substrate 32 to which the stripe asperities 31 are transferred to is obtained (FIG. 4D).

In addition to the exemplary methods of forming nano-scale roughness, as described above with reference to FIGS. 3A through 3E and 4A through 4D, the nano-scale roughness may be formed by using various other methods.

The nano-scale roughness, which is formed on a surface of a developer contact medium as described above with reference to FIGS. 3A through 3E or FIGS. 4A through 4D, in relation to an adhesion force of a toner will now be described.

Figure 5A:
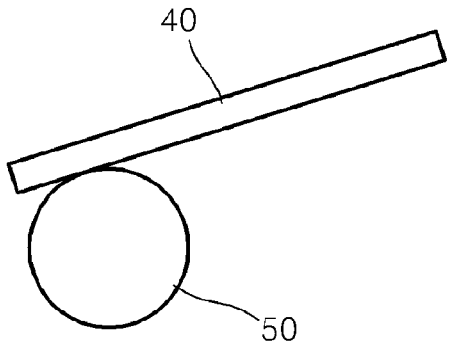
FIGS. 5A and 5B are schematic views illustrating a method of measuring the adhesion force of a developer contact medium.
Figure 5B:
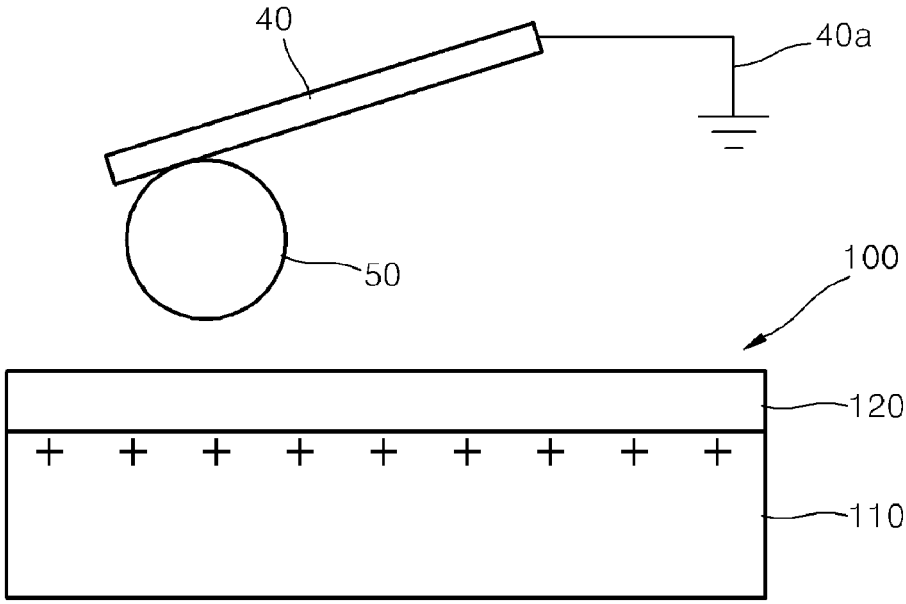

The adhesion force of the toner may be measured using an automatic force microscope (AFM) or an electric force microscope (EFM). As illustrated in FIG. 5A, a polymer particle 50 is adhered to an end of a cantilever 40 of the AFM or the EFM. In order to measure relative reduction of the adhesion force, a polymer particle that is easily measurable is initially used instead of an actual toner particle. In order to provide conductivity, platinum may be sputter-coated on the particle 50 and, as illustrated in FIG. 5B, the adhesion force with respect to a contact medium 100 is measured while grounding the cantilever 40 via a ground terminal 40*a*. The EFM measures the adhesion force by applying a voltage to the contact medium 100 and the AFM measures the adhesion force without applying a voltage to the contact medium 100. The EFM applies a voltage to the contact medium 100 in order to provide a condition that a toner moves with charges in developing and printing operations, and the AFM measures the adhesion force without an electrical force.

A silicon substrate 110 on which a polymer layer 120 is spin-coated is used as the contact medium 100 and nano-scale roughness is formed by forming stripe asperities 31 by using lithography. The silicon substrate 110 on which the polymer layer 120 is spin-coated without forming the nano-scale roughness is used as a comparative sample.

Initially, measurement results of the AFM will now be described.

Figure 6A:
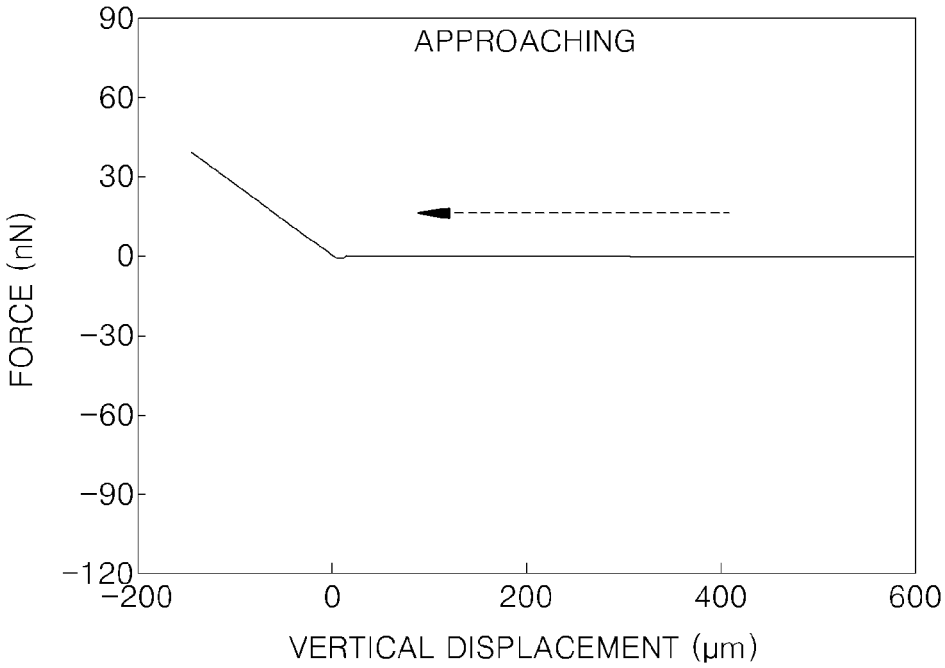
FIGS. 6A and 6B are graphs illustrating an adhesion force of a developer contact medium with respect to a vertical displacement.
Figure 6B:
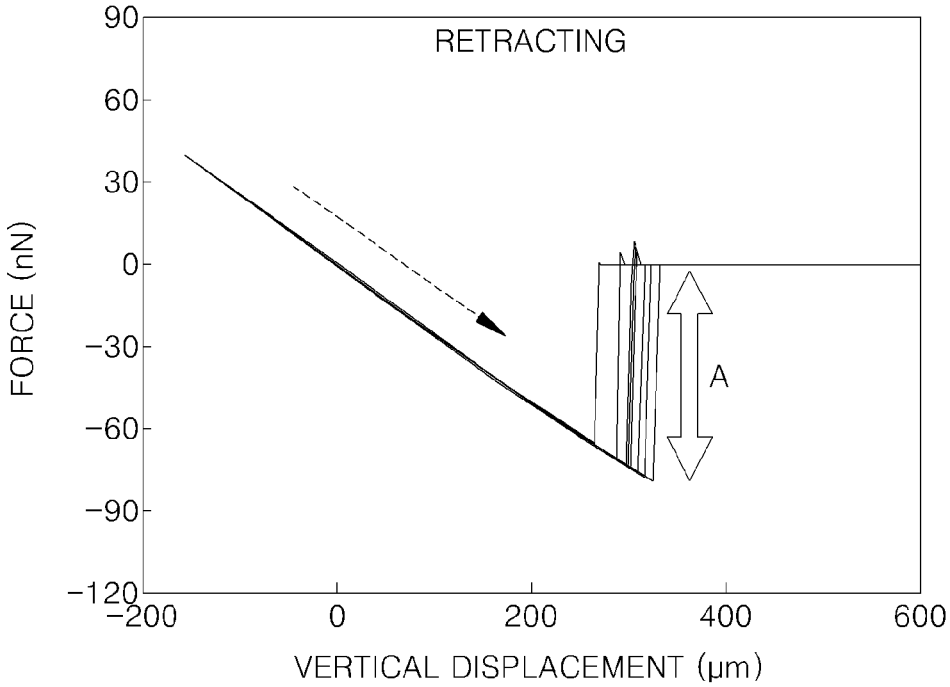

The adhesion force of the toner particles is defined and described below. If the cantilever 40 approaches the contact medium 100 and the particle 50 attached to the end of the cantilever 40 starts to contact a surface of the contact medium 100, as illustrated in FIG. 6A, force sensed by the cantilever 40 increases in a positive direction. Then, if the cantilever 40 retreats away from the contact medium 100, as illustrated in FIG. 6B, the particle 50 is not immediately separated from the contact medium 100 at a point where the particle 50 starts to contact the contact medium 100 (at a point 0 on the X axis) and the force increases in a negative direction while the cantilever 40 is being dragged due to the adhesion force of the particle 50. The force in the negative direction corresponds to the adhesion force of the particle 50 and a value of the force at a moment the cantilever 40 is separated from the contact medium 100 (A indicated in FIG. 6B) may be referred to as the adhesion force of the particle 50.

Figure 7A:
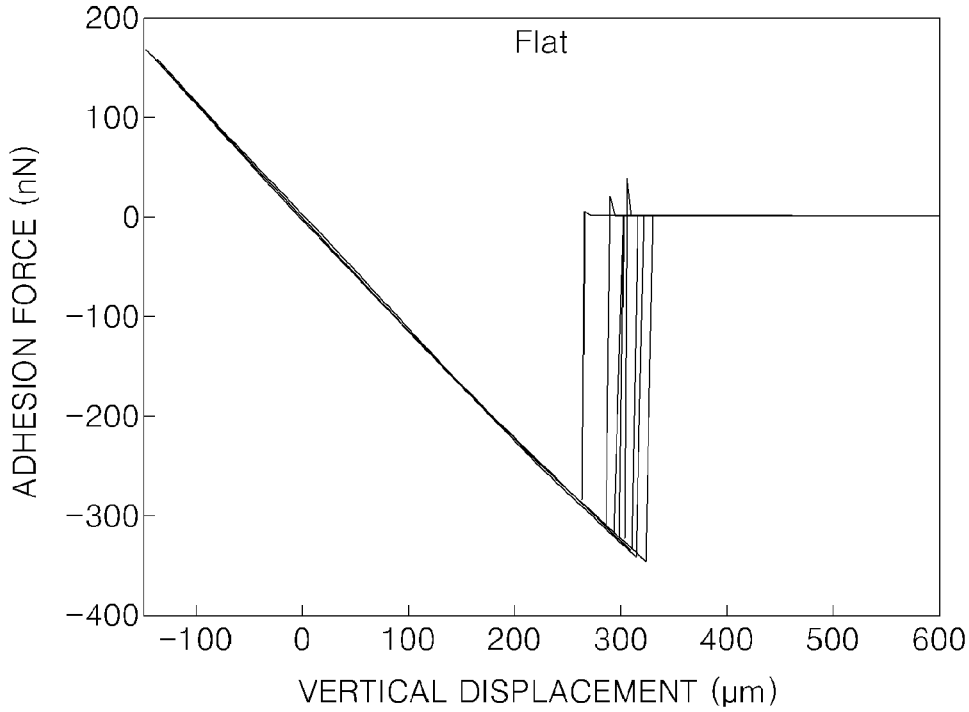
FIGS. 7A through 7C and 8A through 8C are graphs illustrating an adhesion force of particles with respect to a contact medium with and without stripe asperities.
Figure 7B:
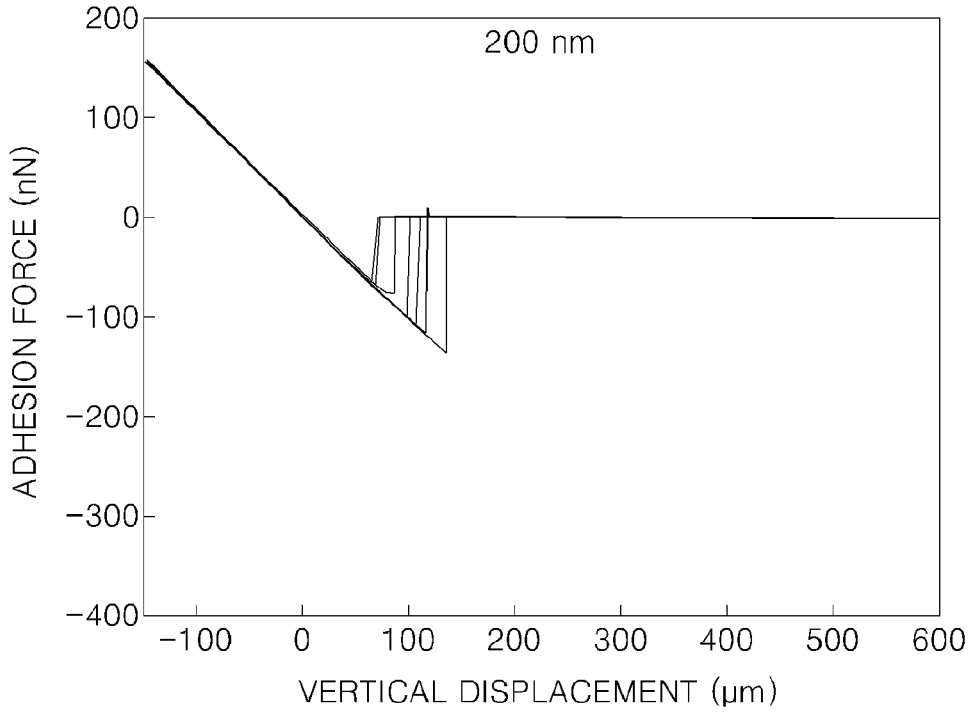
Figure 7C:
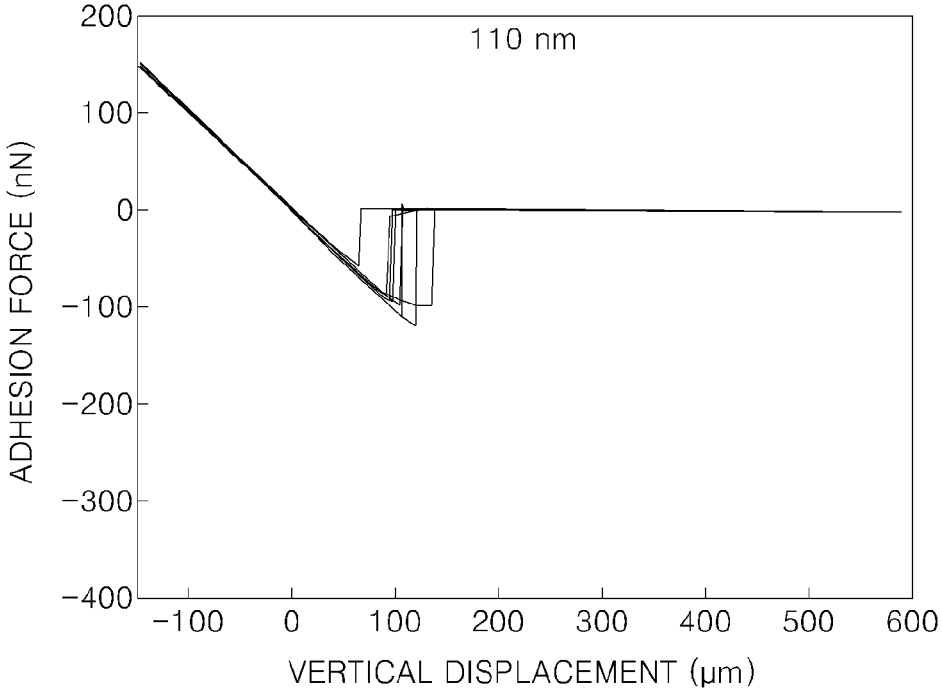

FIGS. 7A through 7C respectively illustrate measurement results when the particle 50 has a diameter of 9.8 μm and the surface of the contact medium 100 is flat (FIG. 7A), nano-scale roughness having a pitch of 200 nm is formed (FIG. 7B), and the nano-scale roughness having a pitch of 110 nm is formed (FIG. 7C). As illustrated in FIGS. 7A through 7C, the adhesion force when the nano-scale roughness is not formed on the surface of the contact medium 100 is greater than 300 nN and the adhesion force when the nano-scale roughness is formed is reduced to about one third of the adhesion force when the nano-scale roughness is not formed.

Figure 8A:
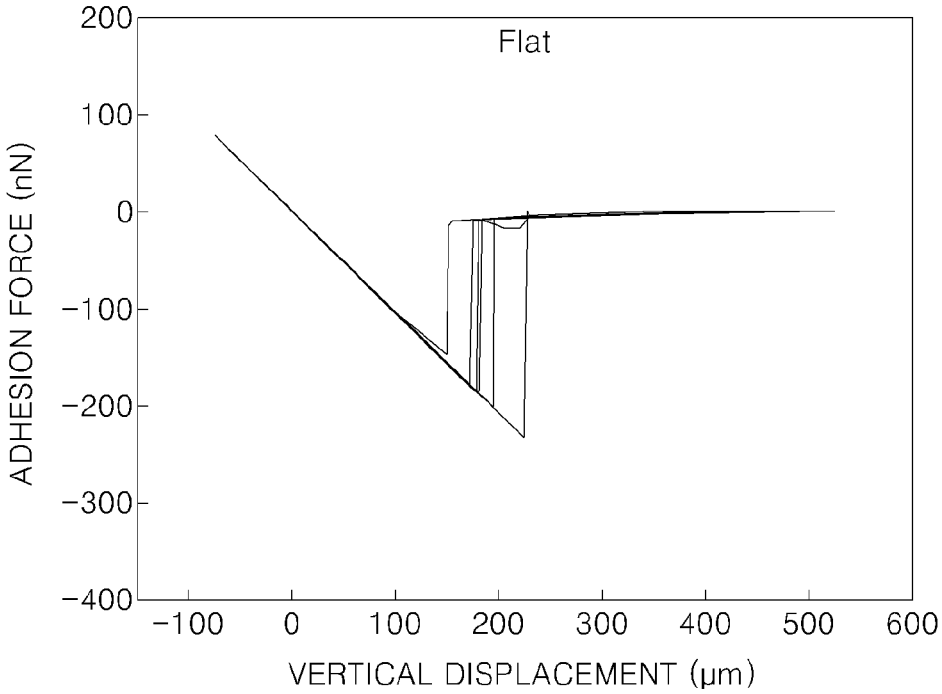
Figure 8B:
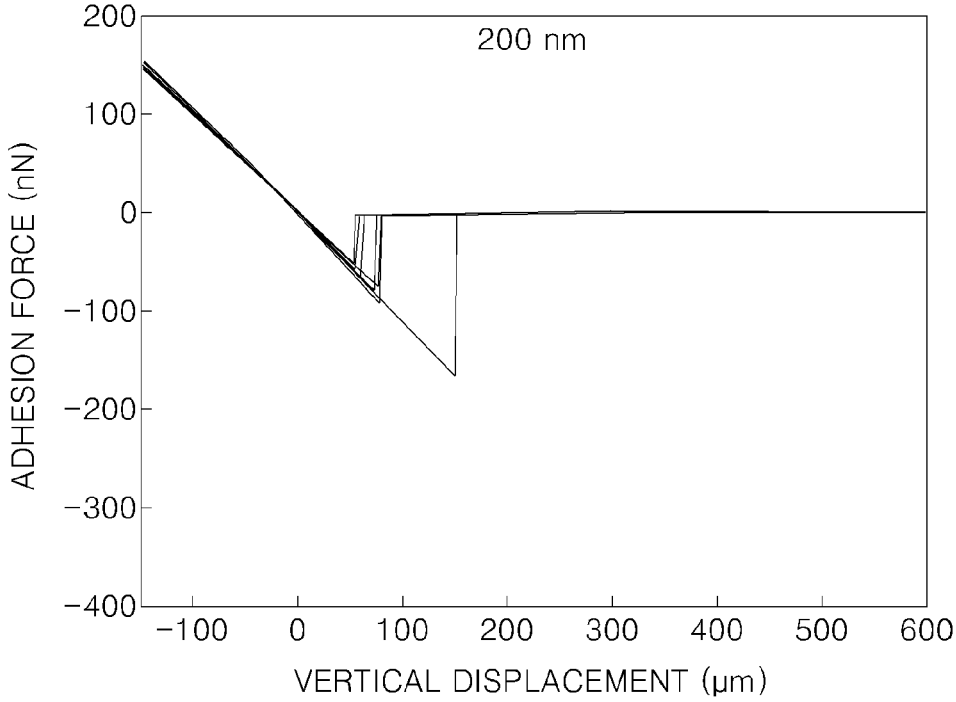
Figure 8C:
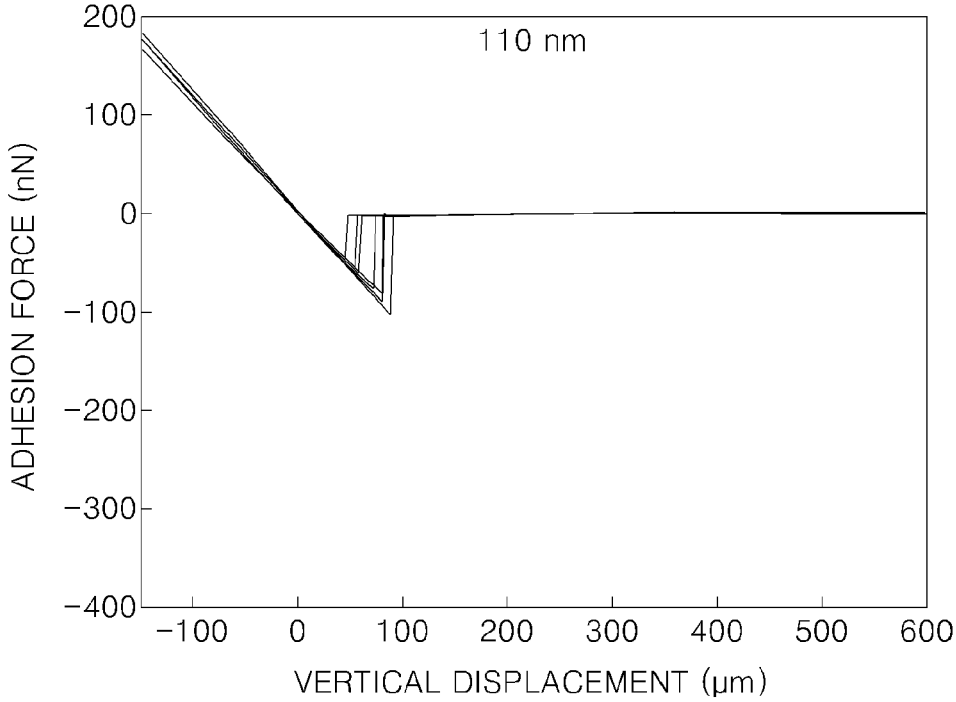
Figure 9A:
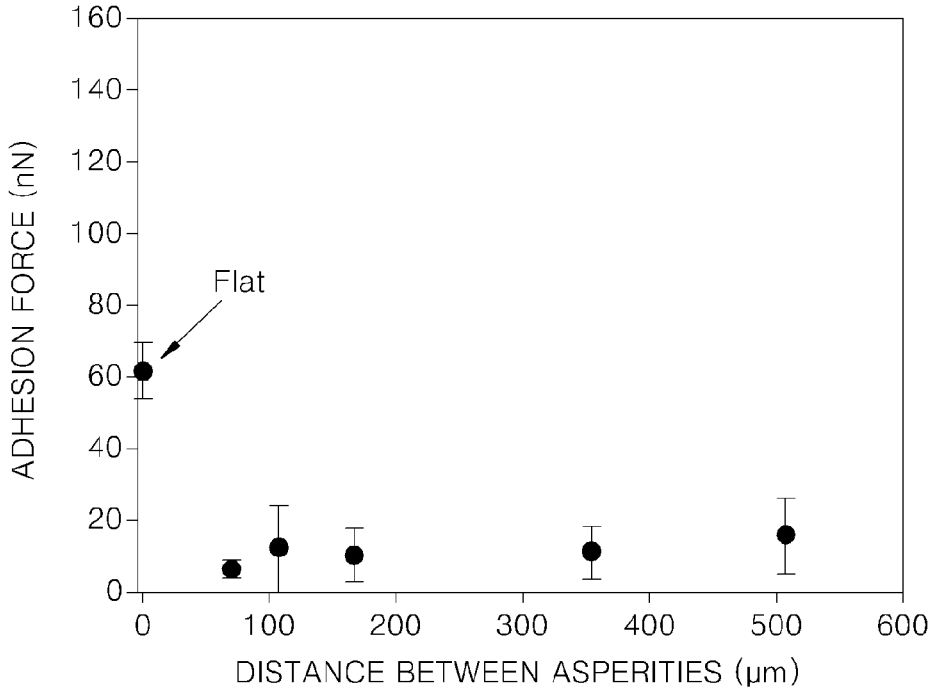
FIGS. 9A through 9F are graphs illustrating an adhesion force of particles with respect to a contact medium including hemispherical asperities.
Figure 9B:
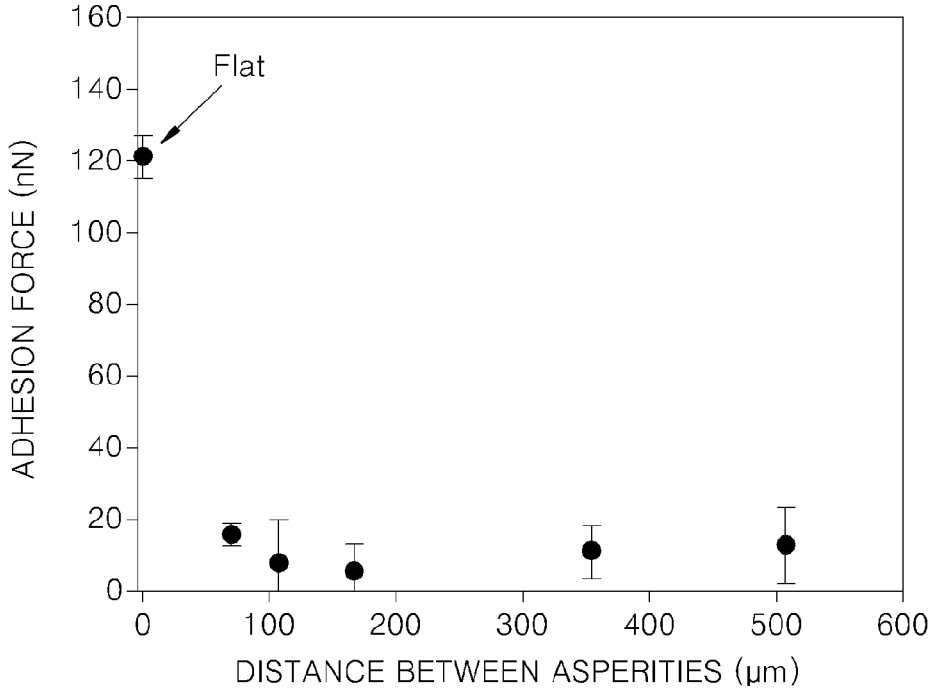
Figure 9C:
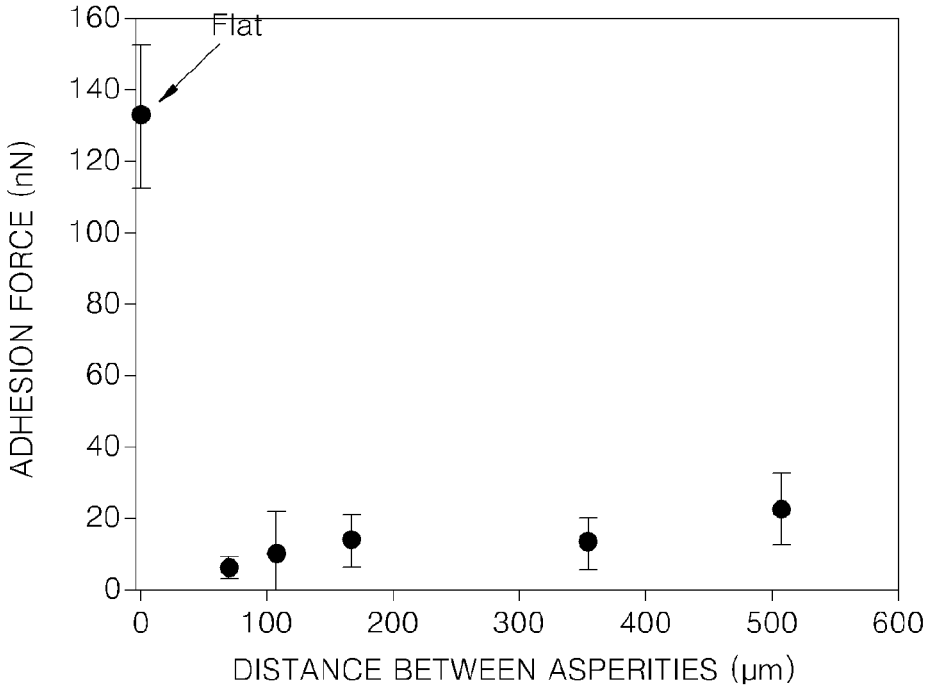
Figure 9D:
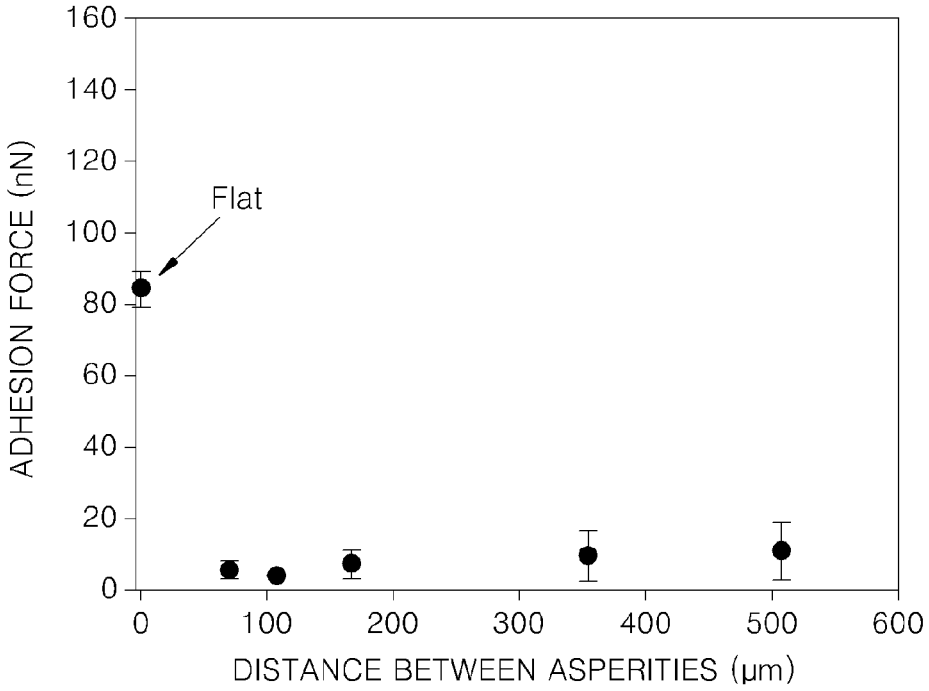
Figure 9E:
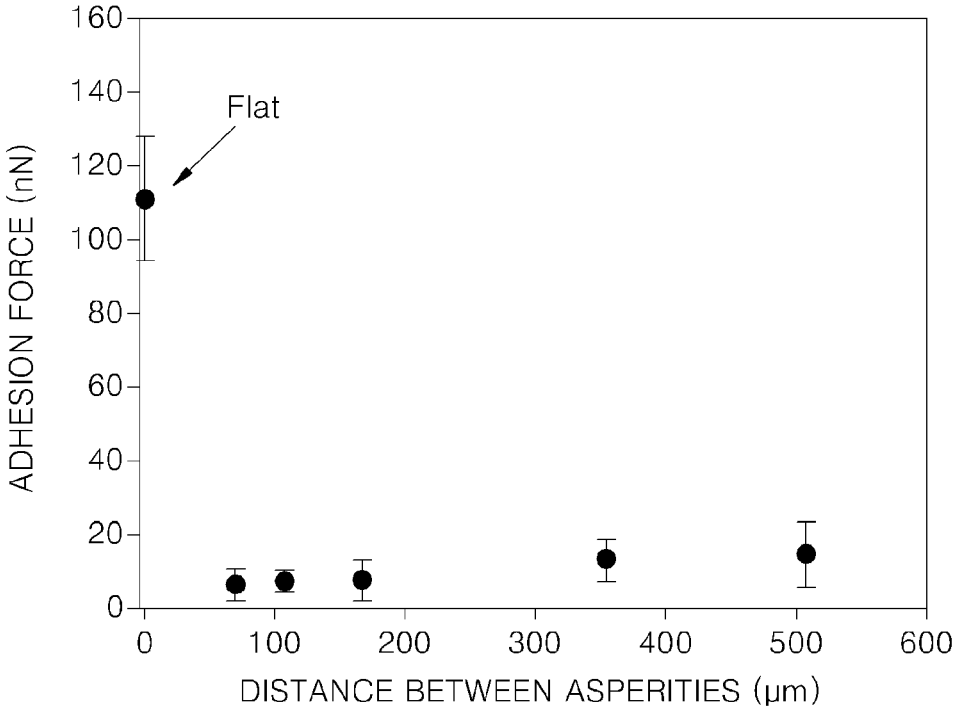
Figure 9F:
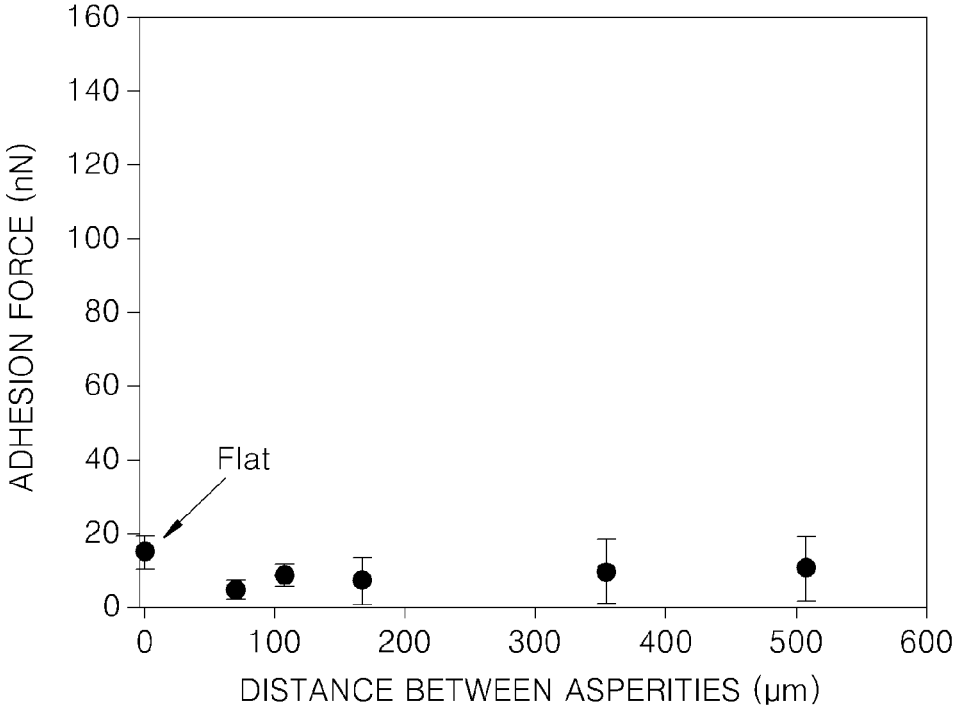

FIGS. 8A through 8C respectively illustrate measurement results when the particle 50 has a diameter of 19.2 μm, almost double than that of the particle 50 described with reference to FIGS. 7A through 7C and the surface of the contact medium 100 is flat (FIG. 8A), the nano-scale roughness having a pitch of 200 nm is formed (FIG. 8B), and the nano-scale roughness having a pitch of 110 nm is formed (FIG. 8C). In general, as in FIGS. 8A through 8C, the adhesion force of the toner is significantly reduced if the nano-scale roughness is formed on the contact medium 100.

FIGS. 9A through 9F respectively illustrate measurement results when the diameter of the particle 50 is changed from 3.4 μm to 28.7 μm, hemispherical asperities are formed on the contact medium 100 as nano-scale roughness, and the adhesion force is measured as described above with FIGS. 5A and 5B.

In each of the graphs illustrated in FIGS. 9A through 9F, the X-axis represents a distance between asperities. A large difference is not recognized until the distance between asperities is changed to 500 nm. However, in comparison to a case when the nano-scale roughness is not formed (flat), the adhesion force is significantly reduced in common.

Figure 10:
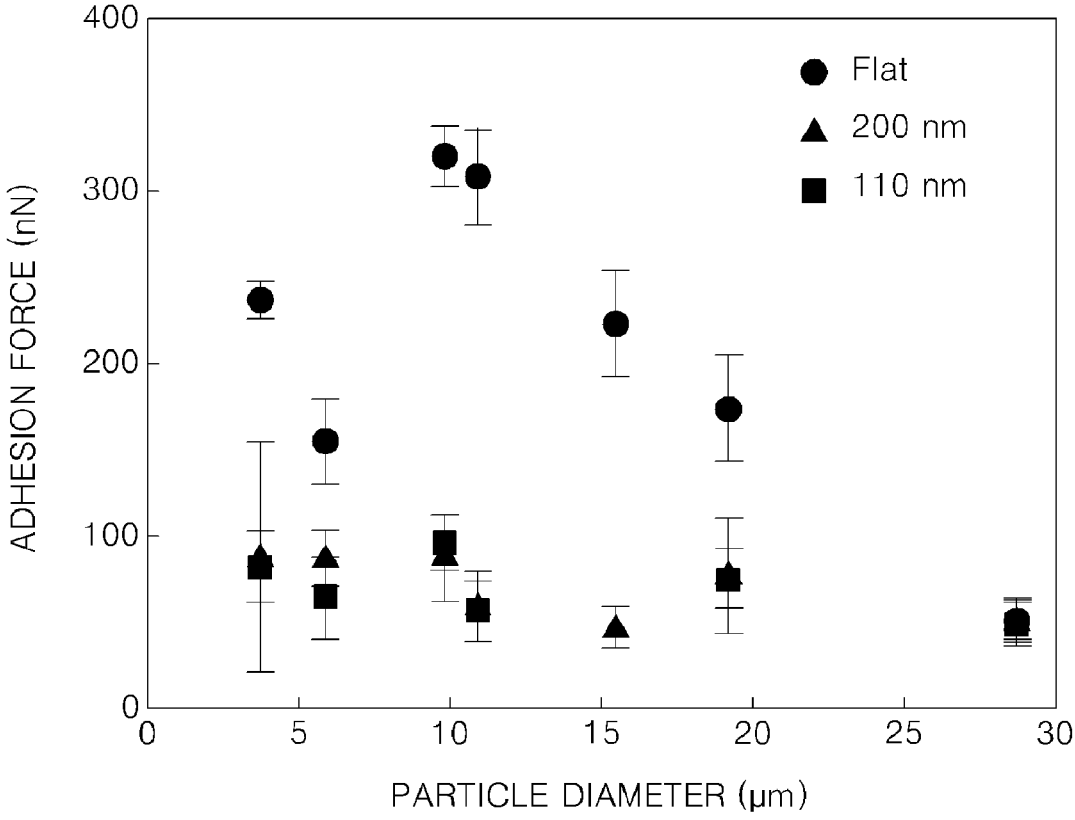
FIG. 10 is a graph illustrating variations in an adhesion force of particles according to a particle diameter.

FIG. 10 illustrates a correlation between the adhesion force and a particle diameter based on the measurement results illustrated in FIGS. 9A through 9F. If the nano-scale roughness is formed, a large difference of the adhesion force according to the particle diameter is not recognized. However, in comparison to a case when the nano-scale roughness is not formed (flat), the adhesion force is significantly reduced.

Now, measurement results of the EFM will be described.

Figure 11A:
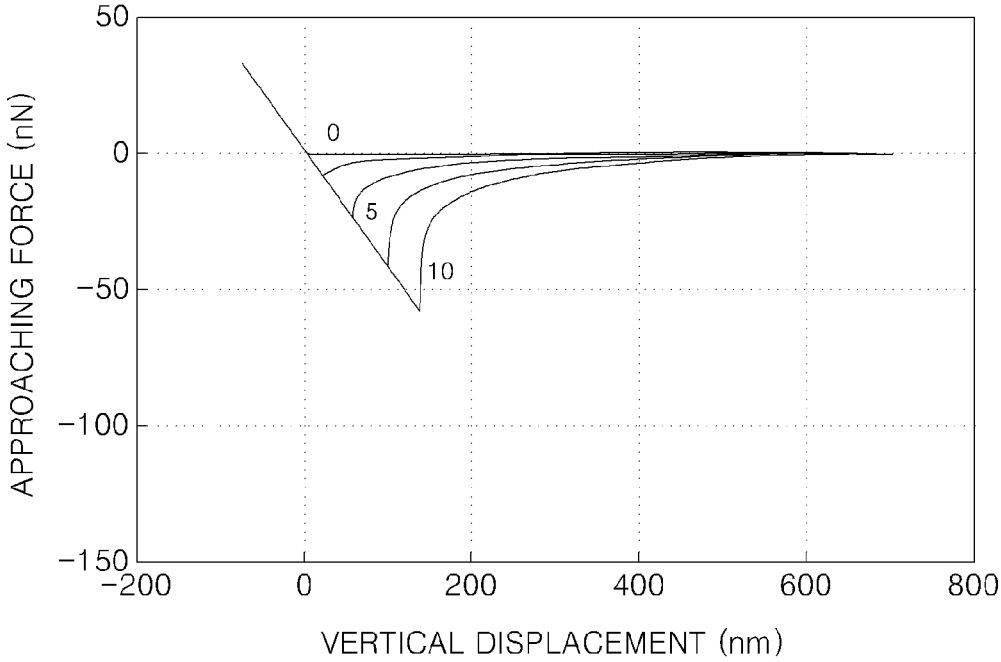
FIGS. 11A, 11B, 12A, and 12B are graphs illustrating variations in an adhesion force of particles according to a voltage applied to a contact medium.
Figure 11B:
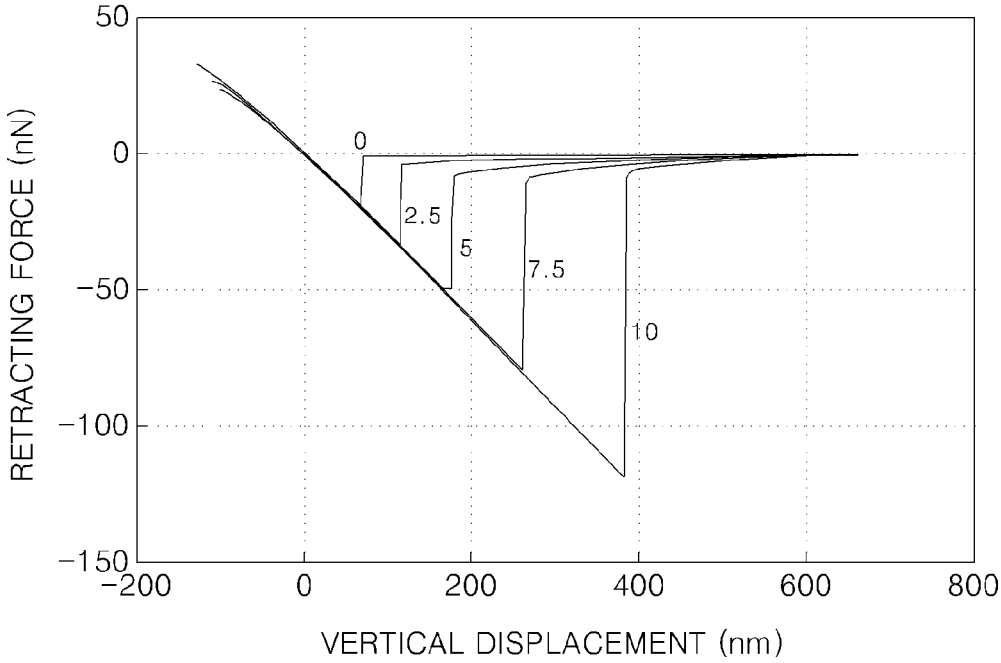
Figure 12A:
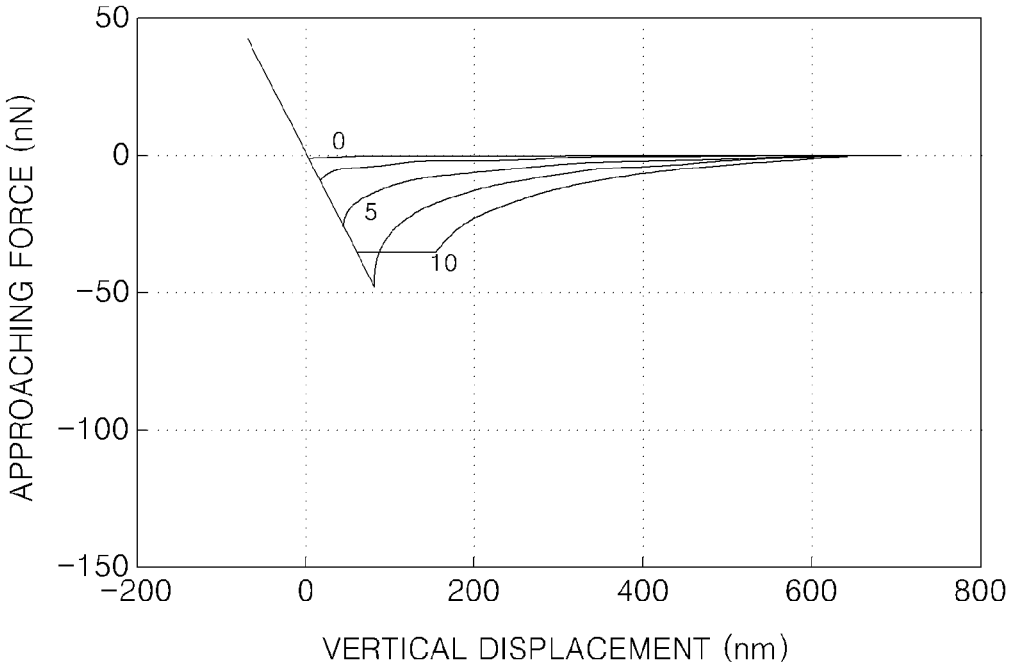
Figure 12B:
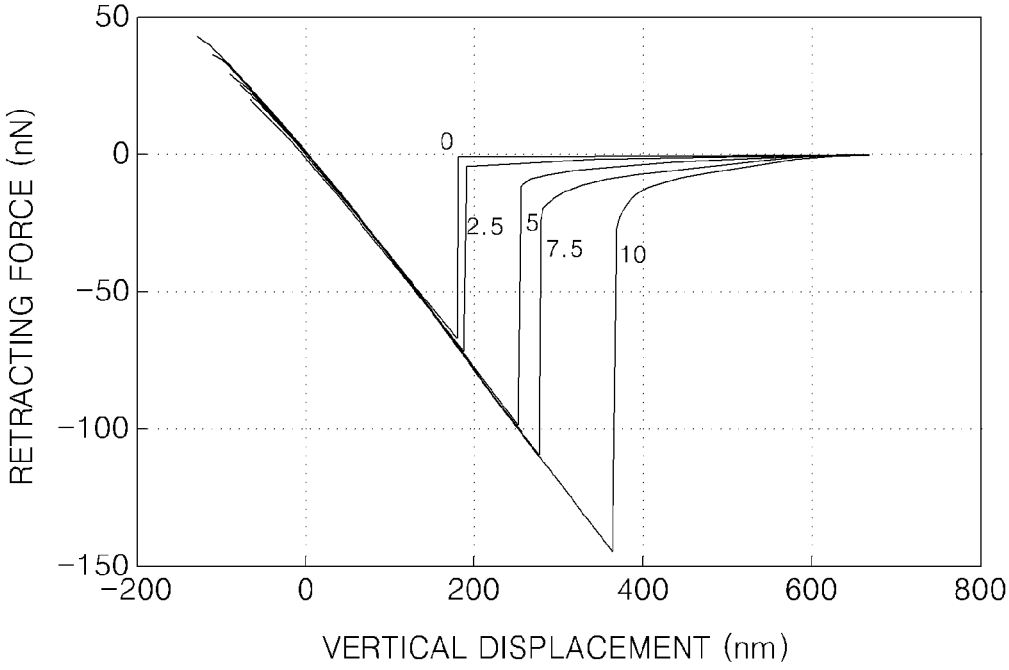

FIGS. 11A and 11B illustrate measurement results of the adhesion force with respect to the contact medium 100 having nano-scale roughness when a particle diameter is 4.9 μm and voltages of 0V, 2.5V, 5V, 7.5V, and 10V are applied to the contact medium 100. Initially, FIG. 11A illustrates variations in force sensed while the cantilever 40 is approaching the contact medium 100. Force exists before a point where the particle 50 contacts the contact medium 100 (at a point 0 on the X axis). This is because electrical force initially acts on the cantilever 40 due to an applied voltage when the cantilever 40 approaches the contact medium 100. Then, if the cantilever 40 is separated from the contact medium 100, as illustrated in FIG. 11B, the adhesion force increases as the applied voltage increases. As a large voltage is applied, the quantity of charges induced to the particle 50 increases and thus the adhesion force also increases. FIGS. 12A and 12B illustrate measurement results when a particle diameter is 10.1 μm. The results illustrated in FIGS. 12A and 12B are similar to the results illustrated in FIGS. 11A and 11B.

Figure 13A:
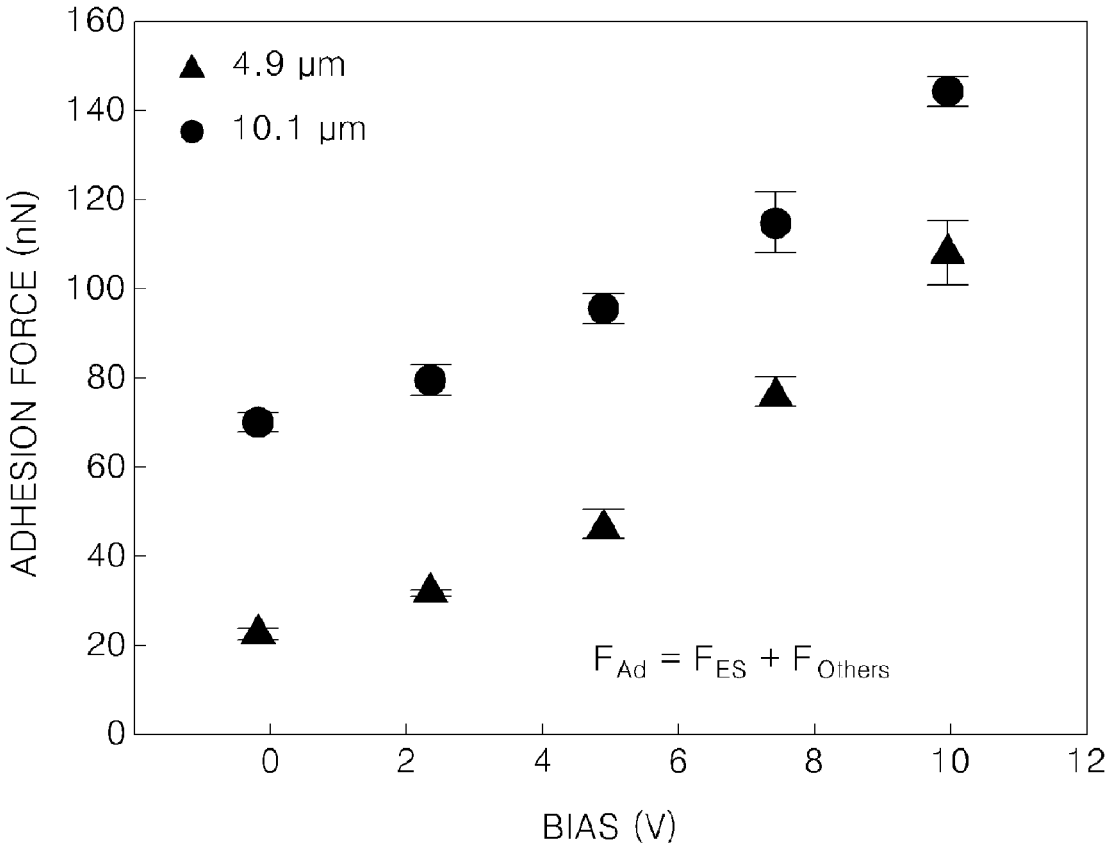
FIGS. 13A through 13D are graphs respectively illustrating correlations between an adhesion force of particles according to a voltage applied to a contact medium, and electrostatic force, a charge quantity, and a charge-to-mass ratio.
Figure 13B:
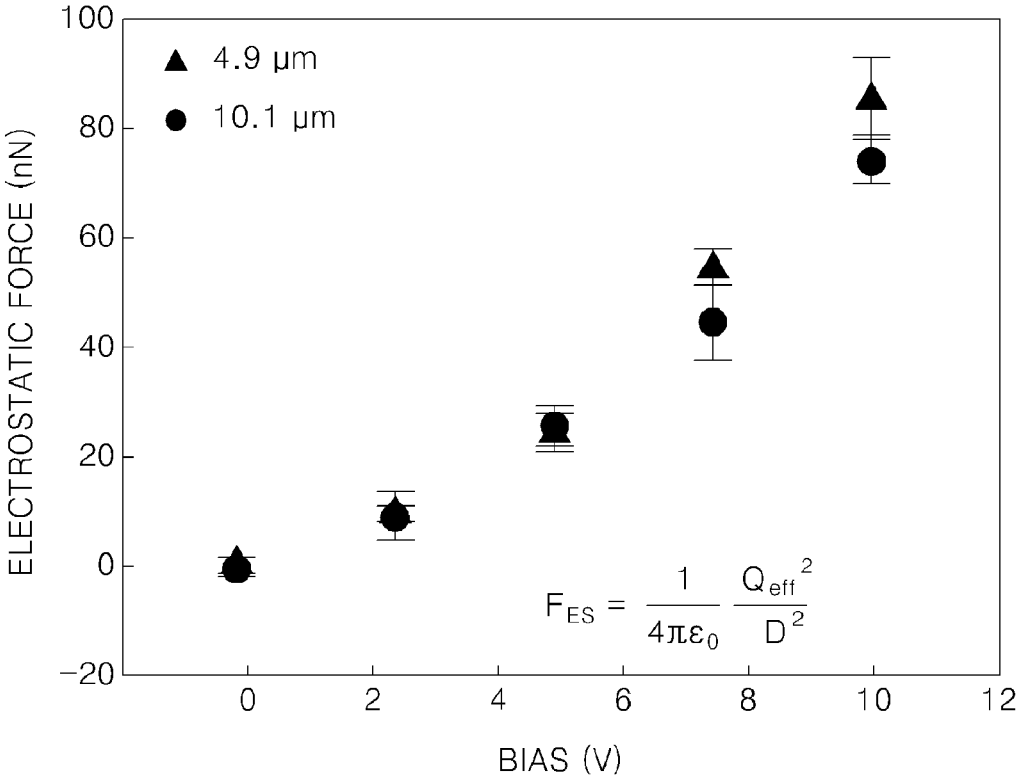

FIG. 13A illustrates adhesion force measured in FIGS. 11A, 11B, 12A, and 12B according to a voltage applied to the contact medium 100. If the voltage increases, the adhesion force increases. That is, variations in the adhesion force occur due to electrostatic force. FIG. 13B illustrates only the electrostatic force by subtracting force when the applied voltage is 0V from values measured in FIG. 13A. In exemplary embodiments, force when the applied voltage is 0V may include van der Waals force, capillary force, etc., and it is assumed that such force does not vary according to the voltage. As illustrated in FIG. 13B, the voltage and the adhesion force have a correlation of a high-order function instead of a linear function, which corresponds to a principle that electrostatic force is proportional to the square of a charge quantity.

Meanwhile, a correlation of $F_{ES}=Q_{eff}^2/(4\pi\cdot\in_0\cdot D^2)$ (D: a distance between charges, ∈: a dielectric constant) is satisfied between electrostatic force $F_{ES}$ and a charge quantity $Q_{eff}$ of the particle 50.

Figure 13C:
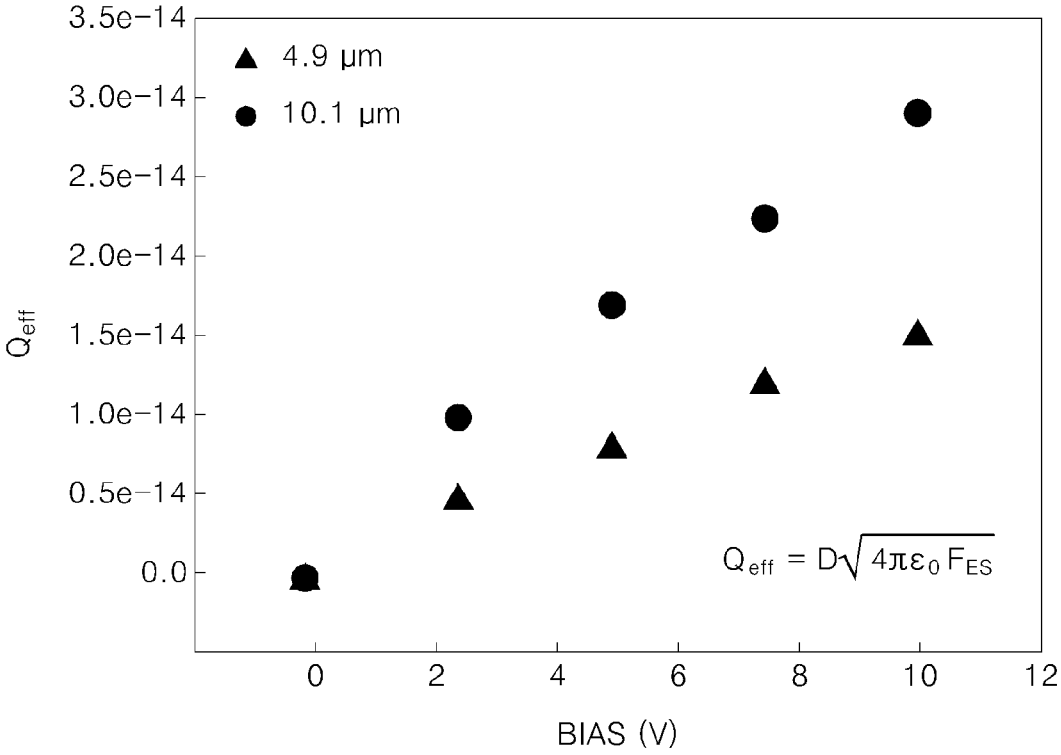
Figure 13D:
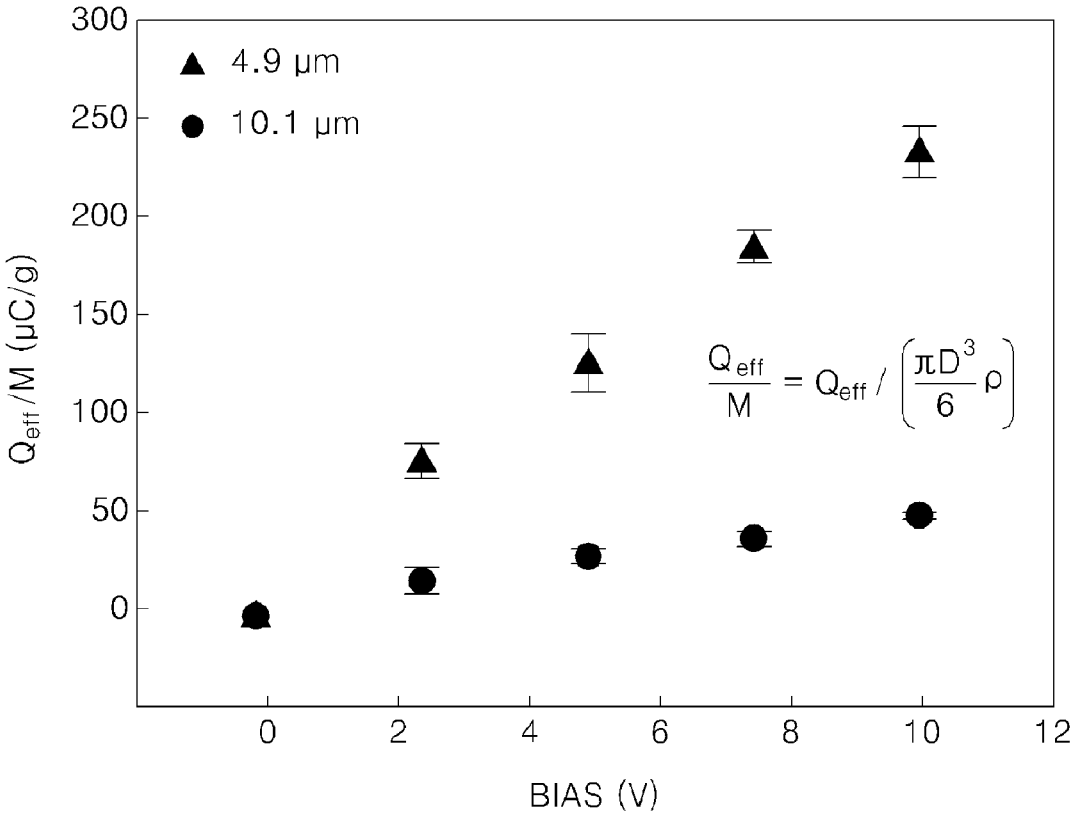

The graph of FIG. 13B may be re-illustrated as the graph of FIG. 13C with respect to a correlation between the applied voltage and the charge quantity based on the above equation. The applied voltage and the charge quantity have a linearly proportional correlation, which closely corresponds to a law of physics regarding a capacitor. As illustrated in FIG. 13B, electrostatic force does not have a large difference according to a particle diameter because, although an overall quantity of charges induced to the particle 50 increases as a particle diameter increases, electrostatic force that is proportional to the square of the particle diameter offsets the influence of the particle diameter. As illustrated in FIG. 13C, if the diameter of the particle 50 is large, the quantity of charges is also large because an areal density from charges applied from the contact medium 100 to charges induced to the particle 50 is almost uniform and thus the overall quantity of charges increases if the particle diameter increases. FIG. 13D illustrates measurement results obtained by dividing the results illustrated in FIG. 13C by a particle mass, which closely corresponds to a fact that an absolute value of the charge quantity of an actual toner particle is about 5 μC/g to about 30 μC/g.

As illustrated in FIGS. 13A through 13D, the measurement results are accurate and correspond to a well-known law of physics or characteristics of an actual toner.

Figure 14:
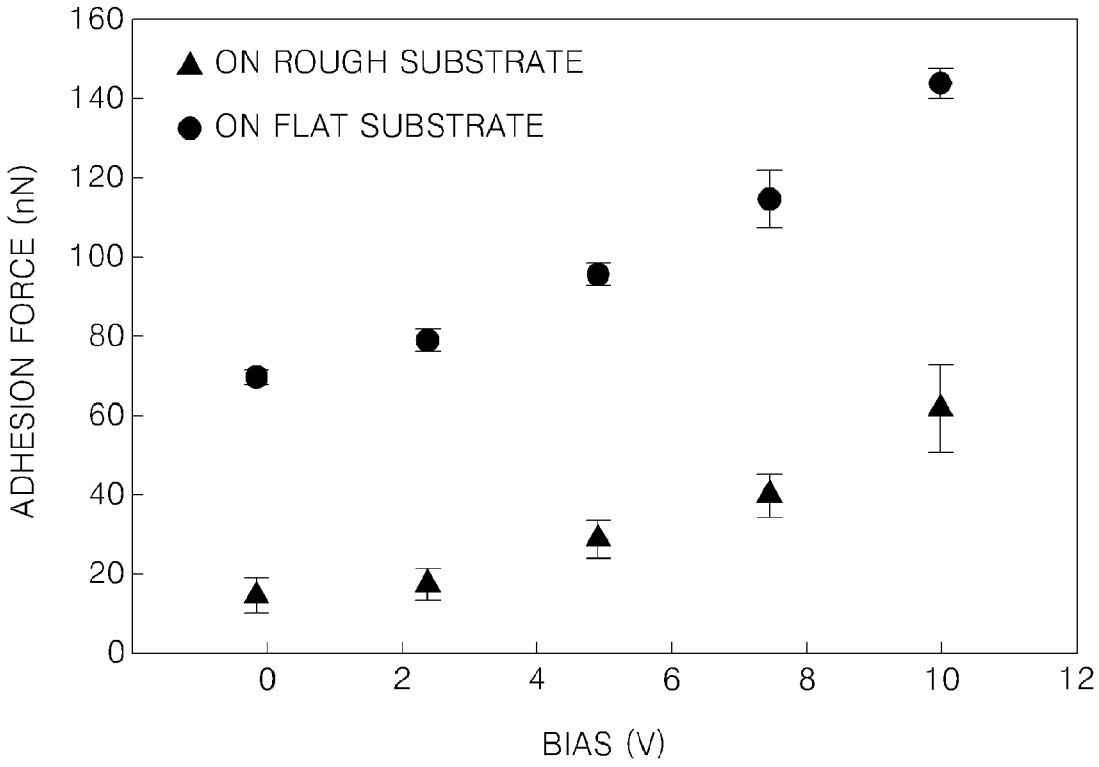
FIG. 14 is a graph illustrating correlations between an applied voltage and an adhesion force of particles with respect to a contact medium having a flat surface and a contact medium having nano-scale roughness.

FIG. 14 illustrates measurement results of the adhesion force of the particle 50 using an EFM with respect to a contact medium having a flat surface and a contact medium having nano-scale roughness. Like the measurement results using an AFM, the adhesion force is significantly reduced if the nano-scale roughness is formed.

Hereinabove, the measurement results are obtained by using a polymer particle instead of a toner particle, and the adhesion force is also measured using actual toner particles. Particles of a toner formed by using a polymerization method (hereinafter the toner will be referred to as a polymerized toner) and a toner formed by using a pulverization method (hereinafter the toner will be referred to as a pulverized toner) are selected as the toner particles. However, the present general inventive concept is not limited thereto. The polymerized toner has an average particle diameter of about 6.02 μm, has a relatively narrow distribution of the particle sizes, and has almost spherical particles. The pulverized toner has an average particle diameter of about 7.49 μm, has a relatively wide distribution of the particle sizes, and has amorphous particles.

Figure 15:
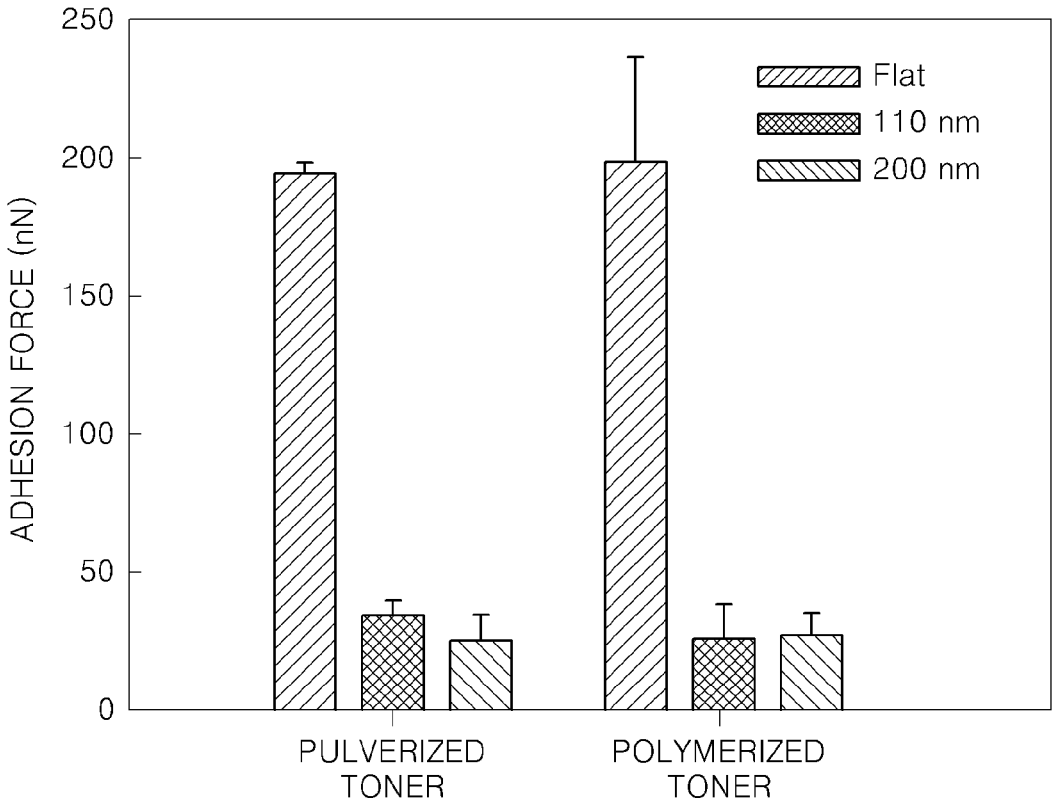
FIGS. 15, 16A, and 16B are graphs illustrating an adhesion force of particles of actual toners.

The adhesion force of these toner particles is measured using an AFM with respect to a contact medium on which stripe asperities having a pitch of 110 nm are formed, a contact medium on which stripe asperities having a pitch of 200 nm are formed, and a flat contact medium without the nano-scale roughness. As a result, as illustrated in FIG. 15, like the measurement results obtained by using a polymer particle, the adhesion force is significantly reduced in the contact media having the nano-scale roughness in comparison to the flat contact medium.

Figure 16A:
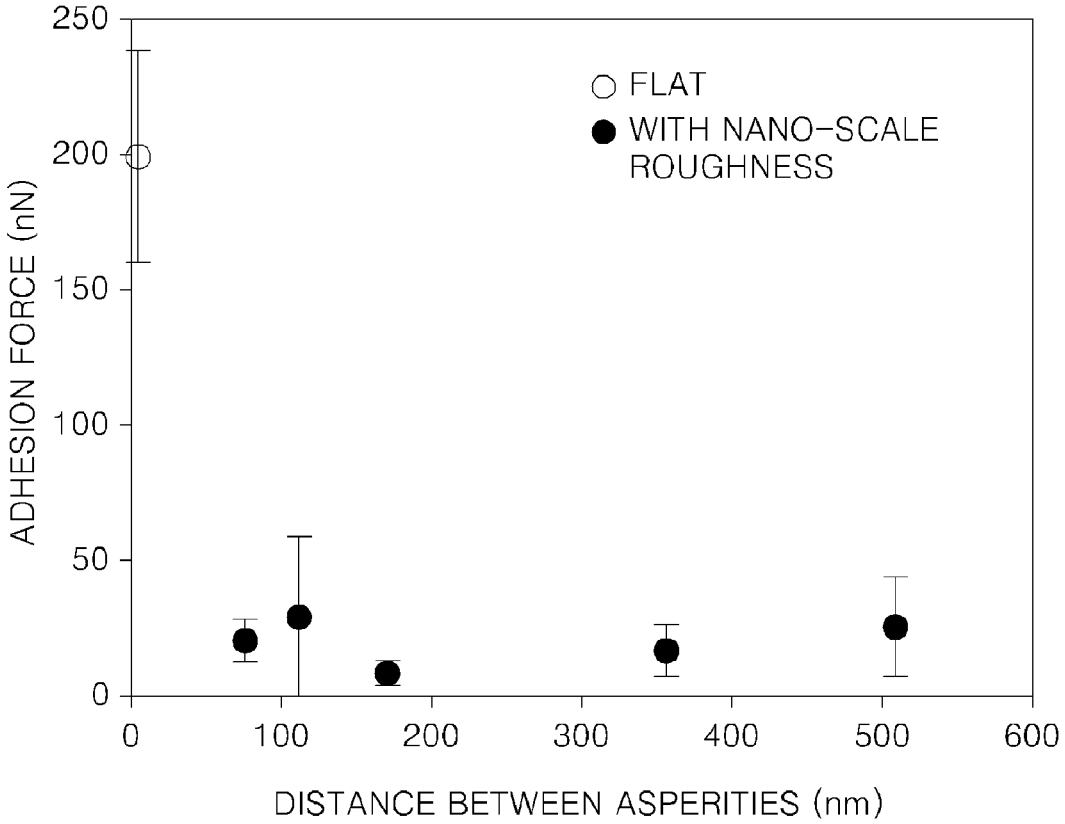
Figure 16B:
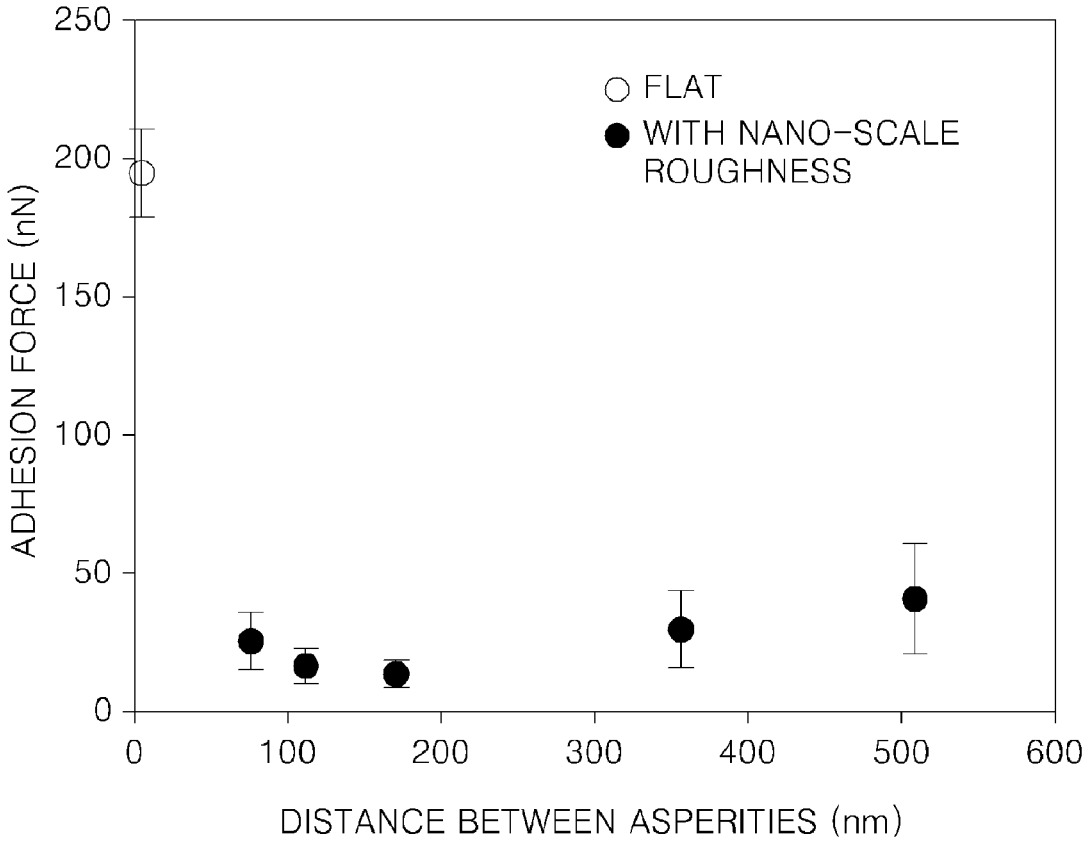

FIGS. 16A and 16B illustrate measurement results of the adhesion force with respect to contact media on which hemispherical asperities are formed instead of stripe asperities. Likewise, the adhesion force is quite large with respect to a flat contact medium without the nano-scale roughness but the adhesion force is significantly reduced to similar levels with respect to the contact media having the nano-scale roughness regardless of whether a distance between asperities is 80 nm or 500 nm.

If the adhesion force is reduced to 100 nN or less, toner particles may smoothly move between contact media. Thus, if the nano-scale roughness is formed on developer contact media such as a developing member, a photosensitive member, a transfer member, and a fusing member of an image forming apparatus, and based on the above measurement results, the adhesion force may be maintained at 100 nN or less and a clear image may be smoothly printed. The nano-scale roughness means a roughness including asperities having a height less than about 1 μm, and if the density of the asperities is in a range of about $4\times10^8$ to about $200\times10^8$ pcs/cm$^2$, the above-described effect of the adhesion force reduction may be achieved. All of the above-described measurement results regarding the nano-scale roughness may be regarded as being obtained when asperities have a height less than about 1 μm, the density of the asperities is in a range of about $4\times10^8$ to about $200\times10^8$ pcs/cm$^2$, and a pitch of stripe asperities or a distance between hemispherical asperities is equal to or less than about 500 nm. If a developer contact medium having the nano-scale roughness is used, a toner may clearly and smoothly move between the developer contact medium, a clean image may be obtained, and a cleaning process may be smoothly performed. Thus, in exemplary embodiments, a lifespan of a contact medium may be increased.

Also, some various methods of forming nano-scale roughness will now be introduced. In exemplary embodiments, a nano-scale porous template may be positioned on a substrate and then roughness may be formed by using an electroplating method or a deposition method. Alternatively, roughness may be formed by using a corrosion method instead of using a template. However, the present general inventive concept is not limited thereto. Thus, if nano-scale roughness is formed on a developer contact medium by using various methods, problems such as image deterioration or cleaning defections caused by excessive adhesion force of a toner may be solved.

While the present general inventive concept has been particularly illustrated and described with reference to exemplary embodiments thereof, it will be understood by those of ordinary skill in the art that various changes in form and details may be made therein without departing from the spirit and scope of the present general inventive concept as defined by the following claims.

What is claimed is:

1. An image forming apparatus comprising:

a developer to develop an image; and a developer contact medium of which a surface contacts the developer, wherein asperities with a density of about $4\times10^8$ to about $200\times10$•pcs/cm$^2$ are formed to form roughness on the surface of the developer contact medium.

2. The image forming apparatus of claim 1, wherein the asperities are protrusions protruded on the surface of the developer contact medium or grooves recessed in the surface of the developer contact medium.

3. The image forming apparatus of claim 1, wherein the asperities are nano-scale asperities having a height less than about 1 μm.

4. The image forming apparatus of claim 1, wherein the asperities are stripe patterns and a pitch of the asperities is equal to or less than about 500 nm.

5. The image forming apparatus of claim 1, wherein the asperities are spherical patterns and a distance between the asperities is equal to or less than about 500 nm.

6. The image forming apparatus of claim 1, wherein an adhesion force of the developer with respect to the developer contact medium is equal to or less than about 100 nN.

7. The image forming apparatus of claim 1, wherein the developer contact medium is formed of aluminum and the asperities are formed by anodizing a surface of the aluminum.

8. The image forming apparatus of claim 1, wherein the asperities are formed by coating a coating solution, in which nano particles having a diameter equal to or less than about 1 μm are dispersed, on the surface of the developer contact medium.

9. The image forming apparatus of claim 1, wherein the developer contact medium comprises one of a developing member, a photosensitive member, a fusing member, and a transfer member.

10. The image forming apparatus of claim 9, wherein each of the developing member, the photosensitive member, the fusing member, and the transfer member is one of a roller type and a belt type.

11. A developing unit usable with an image forming apparatus comprising:

a developer to develop an image; and at least one developer contact medium formed with a surface to reduce a force with the developer, wherein the surface has asperities which include at least one of protrusions and recessed grooves, and wherein the asperities are nano-scale asperities having a height less than about 1 μM.

* * * * *